US008240509B2

(12) United States Patent
Geiger

(10) Patent No.: US 8,240,509 B2
(45) Date of Patent: Aug. 14, 2012

(54) PRESSURE VESSEL CONTAINING POLYETHYLENE GLYCOLS AND CARBON DIOXIDE AS A PROPELLANT

(75) Inventor: Jörg Geiger, Murg-Niederhof (DE)

(73) Assignee: Aerosol-Service AG, Molin (CH)

( * ) Notice: Subject to any disclaimer, the term of this patent is extended or adjusted under 35 U.S.C. 154(b) by 917 days.

(21) Appl. No.: 12/299,414

(22) PCT Filed: May 3, 2007

(86) PCT No.: PCT/CH2007/000221

§ 371 (c)(1),
(2), (4) Date: Nov. 3, 2008

(87) PCT Pub. No.: WO2007/128157

PCT Pub. Date: Nov. 15, 2007

(65) Prior Publication Data

US 2009/0184131 A1 Jul. 23, 2009

(30) Foreign Application Priority Data

May 4, 2006 (CH) ..... 724/06

(51) Int. Cl.
*B65D 35/28* (2006.01)

(52) U.S. Cl. ..... 222/95; 222/105; 222/389; 222/386.5

(58) Field of Classification Search ..... 222/94, 222/95, 105, 389, 386.5
See application file for complete search history.

(56) References Cited

U.S. PATENT DOCUMENTS

| | | | | |
|---|---|---|---|---|
| 3,031,347 | A * | 4/1962 | Philipson | 149/19.5 |
| 4,685,597 | A * | 8/1987 | Hirao et al. | 222/389 |
| 5,009,340 | A | 4/1991 | Morane | |
| 5,054,651 | A | 10/1991 | Morane | |
| 5,167,347 | A * | 12/1992 | Wiegner et al. | 222/94 |
| 6,581,807 | B1 * | 6/2003 | Mekata | 222/402.1 |
| 2002/0185501 | A1 * | 12/2002 | Yquel | 222/94 |

FOREIGN PATENT DOCUMENTS

| | | |
|---|---|---|
| EP | 0 014 147 | 10/1980 |
| EP | 0 314 554 | 5/1989 |
| EP | 0 569 590 | 11/1993 |
| EP | 0 776 834 | 6/1997 |
| JP | 54 093214 | 7/1979 |
| JP | 03 124585 | 5/1991 |

OTHER PUBLICATIONS

Catalytic Reduction of CO2 into Liquid Fuels: Simulating Reaction under Geologic Formation Conditions, by D. Mahajan et al, American Chemical Society, p. 166-180, published Jan. 24, 2002.

(Continued)

*Primary Examiner* — Len Tran
*Assistant Examiner* — Jennifer Gordon
(74) *Attorney, Agent, or Firm* — Hershkovitz & Associates, LLC

(57) ABSTRACT

Disclosed are pressure vessels, especially an aerosol container, which comprise an interior that is subdivided into a storage chamber (3) and a propellant chamber (4) and are operated by means of a two-phase propellant. The gas phase (5) of the propellant encompasses carbon dioxide while the liquid phase (6) encompasses polyethylene glycol and/or a ($C_1$-$C_4$) monoether and/or a ($C_1$-$C_4$) diether of a polyethylene glycol, and carbon dioxide that is dissolved therein.

14 Claims, 6 Drawing Sheets

OTHER PUBLICATIONS

Solubilities of Carbon Dioxide in Polyethylene Glycol Ethers, by Amr Henni et al., The Canadian Journal of Chemical Enfineers, vol. 83, Apr. 2005.

Search Report of International Application PCT/CH2007/000221372, mailed Sep. 25, 2007.

International Preliminary Examination Report, mailed Sep. 25, 2007.

* cited by examiner

PRESSURE VESSEL CONTAINING POLYETHYLENE GLYCOLS AND CARBON DIOXIDE AS A PROPELLANT

FIELD OF THE INVENTION

The present invention relates to pressure vessels, in particular aerosol containers, in which the propellant and the pressurized substance are present in separate chambers.

BACKGROUND OF THE INVENTION

Compared to simple single-chamber pressure vessels or aerosol containers, the abovementioned pressure vessels with separate chambers have the advantage that they are able to dispense the substance in any spatial orientation, without the container first having to be shaken. A further advantage of these two-chamber containers is that no consideration has to be taken of possible chemical incompatibilities between the propellant and the substance.

Examples of such containers are, on the one hand, the spray containers which, in their interior comprise a flexible bag with the sprayable substance, and in which the propellant fills the space between this bag and the actual container. As the container is increasingly emptied of the sprayable substance, the bag is compressed by the action of the propellant, thus ensuring that the remainder of the sprayable substance is still pressurized. The term "bag in a can" is often used in this field for such containers. Examples of two-chamber containers of this first type available on the market at the date of filing of the present application are the containers sold by the Applicant of the present application under the trade names LamiPACK, COMPACK, MicroCOMPACK and AluCOMPACK. Other examples are the containers under the BiCan® brand from Crown Aerosols (England), the containers sold by the company EP Spray Systems SA (Switzerland) under the trade name "EP Spray", and the containers available under the Sepro® brand from the United States Can Company.

Another category of such containers are those that are referred to in this field by the term "can-in-a—can". Here, instead of the flexible bag, a second, inner can is provided which gradually collapses under the action of the propellant and as it increasingly empties.

A further category of two-chamber containers are the containers in which the propellant presses from underneath against a movable piston located in the container. This piston is typically arranged initially near the bottom of the container; the propellant is located in the space between the container bottom and the piston. The substance to be sprayed is located above the piston in the remaining space of the container. As the container is increasingly emptied of the sprayable substance, the piston slides upwards inside the container, under the action of the propellant, and thus ensures that the remaining portion of the sprayable substance is still pressurized. Pressure vessels of this kind comprising a piston are sold by the United States Can Company, for example.

The propellants used in the above-described two-chamber containers are typically gaseous carbon dioxide, air, nitrogen, liquefied gases, for example propane and butane, fluorochlorinated hydrocarbons or fluorinated hydrocarbons.

The solubility of carbon dioxide in POLYETHYLENE GLYCOL 400 was determined in an article ("ACS Symposium Series", 2002, pages 166-180) in view of providing solvents for the catalytic reduction of carbon dioxide (for reducing greenhouse gases).

In another article ("Canadian Journal of Chemical Engineering" 83(2), 2005, pages 358-361), again in view of reducing the greenhouse gas carbon dioxide, the solubility of carbon dioxide in different ethers of different polyethylene glycols was examined.

The object of the present invention is to make available an improved pressure vessel of the above mentioned type.

SUMMARY OF THE INVENTION

According to the invention, the object is achieved by a pressure vessel for receiving a pressurized substance in gaseous, liquid or finely particulate form, said pressure vessel comprising a wall with an inner wall face that defines an interior space of the pressure vessel; a separating part located in the interior and dividing the interior space into a storage chamber and into a propellant chamber, wherein the storage chamber contains the substance and the propellant chamber contains a propellant, wherein the separating part is able to permit liquid-tight division into storage chamber and propellant chamber and, under the action of the propellant, is able to vary the volume ratio between storage chamber and propellant chamber in favour of the propellant chamber; and wherein the pressure vessel is characterized in that the propellant is composed of:

a) a gas phase comprising carbon dioxide, and b) a liquid phase comprising a compound chosen from the polyethylene glycols and their ($C_1$-$C_4$) monoethers and ($C_1$-$C_4$) diethers and carbon dioxide dissolved therein.

Preferred embodiments of the pressure vessel and other subjects of the invention will become apparent from the claims.

DESCRIPTION OF THE INVENTION

Figure 1:
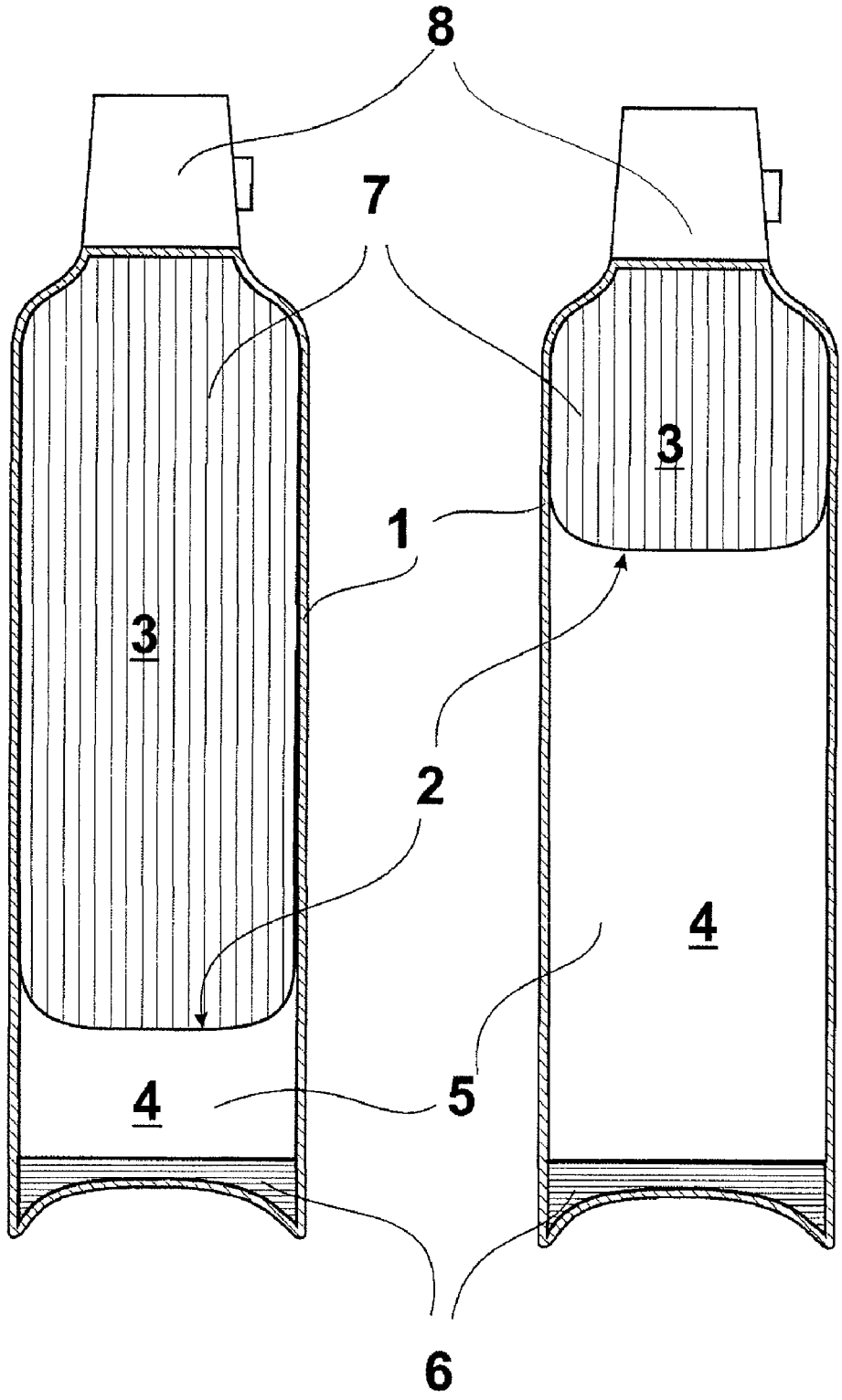
FIGS. 1 and 2 show two other pressure vessels according to the invention with an inner bag, in each case in two different states of filling.

The pressure vessels according to the invention comprise a propellant with a liquid phase which comprises a polyethylene glycol and/or a ($C_1$-$C_4$) monoether and/or a ($C_1$-$C_4$) diether of a polyethylene glycol. The polyethylene glycols or their ethers can be present as pure substances. However, for production reasons, the polyethylene glycols or their ethers are generally mixtures of compounds with different, for example normally distributed, molecular weights.

In the context of the present application, the molecular weights of mixtures of polyethylene glycols or their ethers are understood as weight-average molecular weights $M_W$:

$$M_w = \frac{\sum_{i=1}^{Z} N_i M_i M_i}{\sum_{i=1}^{Z} N_i M_i}$$

where i is an index running over all molecule types of the polyethylene glycol and/or polyethylene glycol monoether and/or polyethylene glycol diether, and $N_i$ and $M_i$ are, respectively, the number of molecules in the i-th molecule species and the molecular weight of the i-th molecule species. As is customary in this field, this mean molecular weight $M_W$ can be determined by light scattering measurements according to the principle of "Multi Angle Light Scattering" (MALS) with laser light on dilute solutions of the polyethylene glycol or polyethylene glycol ether. The measurement devices needed for this purpose are known and are commercially available. The $M_W$ can be determined from the resulting scattering measurements using the Zimm equation and the associated Zimm diagram.

The $M_W$ of the polyethylene glycol and/or of the ether thereof can be chosen as a function of the ambient temperatures at which the pressure vessel according to the invention is intended to be used. At high ambient temperatures, a high-molecular-weight polyethylene glycol and/or a high-molecular-weight polyethylene glycol ether can be used; whereby the polyethylene glycol should be liquid at the desired ambient temperature. The following table shows the typical melting ranges of some representative polyethylene glycols that can be used according to the invention, as a function of their molecular weight:

| $M_W$ of the polyethylene glycol | Melting range (° C.) |
|---|---|
| 200 | −65 to −50 |
| 300 | −15 to −10 |
| 400 | −6 to 8 |
| 600 | 17 to 22 |

If the ambient temperature at which the pressure vessel according to the invention is intended to be used is in the range of approximately room temperature, that is to say from approximately 0° C. to approximately 40° C., the $M_W$ of the polyethylene glycol and/or polyethylene glycol monoether and/or polyethylene glycol diether is preferably in the range of 200 to 600 daltons, more preferably in the range of approximately 250 to approximately 390 daltons, and it is particularly preferably approximately 300 daltons.

Examples of polyethylene glycol monoethers and polyethylene glycol diethers are the compounds listed in Table 1 of the above mentioned reference from the "Canadian Journal of Chemical Engineering". Diethers are preferably used.

The liquid phase of the propellant can, if appropriate, contain a cosolvent. Such cosolvents can be, for example, antifreeze agents such as dipropylene glycol or ethylene glycol; they can also be viscosity-modifying additives such as water; they can also be foam inhibitors such as N-octanol. These cosolvents, if they are to be present, are preferably added in quantities of 0.1 to 5 percent by weight, relative to the liquid phase still free of carbon dioxide.

In a first preferred embodiment, the liquid phase contains only a polyethylene glycol with a $M_W$ in the ranges cited above, if desired in combination with one of the above mentioned cosolvents.

In another preferred embodiment of the invention, the liquid phase contains only a polyethylene glycol diether with a $M_W$ in the ranges cited above, if desired in combination with one of the aforementioned cosolvents. The polyethylene glycol diether is particularly preferably a polyethylene glycol 1,4-dibutyl ether, for example the "Polyglycol BB 300" sold by Clariant.

In the liquid phase of the propellant, the total content of polyethylene glycol and polyethylene glycol monoethers and diethers and of carbon dioxide dissolved therein amounts to preferably at least 90 percent by weight, relative to the liquid phase, more preferably at least 95 percent by weight.

In the gas phase of the propellant according to the invention the ratio of the partial pressure of carbon dioxide to the total pressure is preferably at least 0.90, more preferably at least 0.95, and particularly preferably at least 0.98.

The propellant is preferably produced in advance, before being introduced into the pressure vessel according to the invention. In a pressurized reactor with a pressure gauge, carbon dioxide can be added to a liquid phase comprising a compound chosen from the polyethylene glycols and their ($C_1$-$C_4$) monoethers and ($C_1$-$C_4$) diethers (if desired a vacuum can be applied to the pressurized reactor in order to remove air residues, before the addition of carbon dioxide). Preferably with stirring or shaking, the propellant is allowed to equilibrate, which can be verified by the establishing of constant pressure.

For the starting pressure in the pressure vessel according to the invention, it does not matter in what ratio of liquid phase to gas phase the propellant is introduced into the propellant chamber; the starting pressure in the chamber is equal to the pressure at which the propellant is introduced into the chamber. However, the pressure drop in the propellant chamber, as the sprayed volume ΔV increases, is dependent on the starting volume of the liquid phase and on the entire propellant (i.e. on the starting volume of the propellant chamber), on the number of moles of all the constituents of the propellant (these also determine the ratio of liquid phase to gas phase) and on the temperature:

$$P=f(\Delta V, V_{T0}, N_g, N_1, T) \quad (1a)$$

where $V_{T0}$ is the starting volume of the entire propellant, i.e. the starting volume of the propellant chamber;

$N_g$ is the total number of moles of the carbon dioxide summed over the liquid phase and the gas phase of the propellant (remains constant since no carbon dioxide is discharged from the pressure vessels according to the invention);

$N_1$ is the total of the numbers of moles of all the liquid constituents (polyethylene glycol, polyethylene glycol monoether, polyethylene glycol diether and cosolvents) of the liquid phase of the propellant (remains constant since no liquid phase is discharged from the pressure vessels according to the invention); and T is the absolute temperature.

Using simple measurement equipment, the function (1a) can be experimentally determined for every pressure vessel according to the invention and for every propellant (see description of FIGS. 7 and 8 below).

If the gas present in the propellant is assumed to be pure carbon dioxide and the liquid constituents of the propellant are assumed to be non-volatile, the inverse function (1b):

$$\Delta V=f^{-1}(P, V_{T0}, N_g, N_1, T) \quad (1b)$$

can be calculated, from which (1a) can then be obtained in turn. To do so, a number of formulae are first needed, which are explained below:

a) At the pressures and temperatures typically occurring in the pressure vessels according to the invention, the equilibrium distribution of the carbon dioxide between gas phase and liquid phase can be estimated using the following formula:

$$P_{CO2}=H^{*}x_{CO2}+H_0 \tag{2}$$

where $P_{CO2}$ is the partial pressure of the carbon dioxide in the gas phase of the propellant, $x_{CO2}$ is the mole fraction of the carbon dioxide in the liquid phase of the propellant, and H and $H_0$ are characteristic constants for the respective liquid phase and temperature.

The constants H and $H_0$ can be determined by the method of the aforementioned publication from "ACS Symposium Series" (page 168, sections entitled "Batch Unit" and "Solubility Studies"). In said work, PEG with $M_W$ 400 gave H=9.4 MPa at 25° C. ($H_0$ is approximately −0.5 MPa according to FIG. 3 of said work). In the studies culminating in the present application, PEG with $M_W$ 300 gave H=32.8 MPa and $H_o$=−0.39 MPa at 25° C.

b) The mole fraction $x_{CO2}$ used in (2) is defined as:

$$xco_2 = \frac{{}_1n_g}{{}_1n_g + N_l} \tag{3a}$$

$$= \frac{N_g - {}_gn_g}{N_g - {}_gn_g + N_l} \tag{3b}$$

where ${}_1n_g$ is the number of moles of the carbon dioxide in the liquid phase of the propellant;

${}_gn_g$ is the number of moles of carbon dioxide in the gas phase of the propellant; and $N_g$ and $N_1$ have the meaning indicated above.

c) If (2) and (3b) are combined and resolved according to ${}_gn_g$, this gives:

$${}_gn_g = N_g + N_l \times \frac{P - H_0}{P - (H_0 + H)} \tag{4}$$

d) The van der Waals equation is:

$$\left(P + a \times \frac{{}_gn_g^2}{{}_gV^2}\right)\left(\frac{{}_gV}{{}_gn_g} - b\right) = RT \tag{5}$$

where

P and ${}_gn_g$ are as defined above;

${}_gV$ is the volume of the gas phase;

R is the universal gas constant; and a and b are the van der Waals coefficients of the carbon dioxide; i.e. $3.96\times10^{-1}$ Pa $m^3$ and $42.69\times10^{-6}$ $m^3$/mol.

e) The volume ${}_1V$ of the liquid phase of the propellant is approximated as:

$${}_1V = {}_1V_0 + {}_1n_g \times b \tag{6a}$$

-continued $$= {}_1V_0 + (N_g - {}_gn_g) \times b \tag{6b}$$

where ${}_1V_0$ is the volume of the liquid phase of the propellant still free of carbon dioxide (this value is a constant); and $N_g$, ${}_gn_g$, ${}_1n_g$ and b have the meaning indicated above.

In formulae (6a) and (6b), it is assumed that the liquid phase is incompressible, i.e. that the change of volume of the liquid phase occurs only through absorption or discharge of carbon dioxide. It is further assumed that no interactions take place between dissolved carbon dioxide and the molecules of the liquid phase, which interactions would lead to an additional change of volume.

f) The total sprayed volume ΔV, appearing in (1a) and (1b), is:

$$\Delta V = {}_1V + {}_gV - V_{T0} \tag{7}$$

where ${}_1V$, ${}_gV$ and $V_{T0}$ have the meanings indicated above.

g) The total number of moles $N_1$ in the liquid phase (still without carbon dioxide, constant), appearing in formulae (1a), (1b), (3a), (3b) and (4), can be calculated according to the following formula (8):

$$N_1 = \frac{m(PEG)}{M_w(PEG)} + \frac{m(PEGMonoether)}{M_w(PEGMonoether)} + \frac{m(PEGDiether)}{M_w(PEGDiether)} + ni \tag{8}$$

where m(PEG), m(PEGMonoether) and m(PEGDiether) are the freely selectable masses of polyethylene glycol or polyethylene glycol monoether or polyethylene glycol diether;

$M_W$(PEG), $M_W$(PEGMonoether) and $M_W$(PEGDiether) are the weight-average molecular weights of the polyethylene glycol, polyethylene glycol monoether and polyethylene glycol diether (which can be determined as described above); and $n_1$ is the number of moles of the optional additional cosolvents.

h) The total number of moles $N_g$ of the carbon dioxide summed over the liquid phase and the gas phase of the propellant (constant), appearing in formulae (1a), (1b), (3b), (4) and (6b), can be calculated according to the following formula (9):

$$N_g = r(V_{T0} - {}_1V_0) + N_L(b \times r - 1)\left(\frac{P_0 - H_0}{P_0 - (H_0 + H)}\right) \tag{9}$$

where r is the only real and positive solution of the cubic equation $(P_0+a\times r^2)(1/r-b)=RT$, where $P_0$ in formula (9) and in said cubic equation is the freely selectable starting pressure in the propellant chamber; and $V_{T0}$, ${}_1V_0$, a, b, H and $H_0$ have the meanings indicated above.

To determine a curve according to formula (1b), the $N_1$ and $N_g$ are first determined by means of the formulae (8) and (9), respectively. For each value pair P, ΔV to be determined for this curve, the following is then carried out:

a) A pressure P is chosen that lies within a typical range for the pressure vessel according to the invention; this pressure should not be greater than the starting pressure $P_0$ chosen for formula (9);

b) with this P, formula (4) is used to calculate ${}_gn_g$;

c) with P and $_gn_g$, formula (5) is used to determine $_gV$, with formula (5) being transformed to a cubic equation in $_gV$, and $_gV$ being determined as the only real and positive solution of this transformed equation;

d) with $_gn_g$, formula (6b) is used to determine $_1V$;

e) with $_gV$ and $_1V$, formula (7) is used to determine the ΔV associated with P.

The value pairs P, ΔV thus obtained can be plotted as P (y-axis) over ΔV (x-axis), which yields a curve according to formula (1b); they can also be plotted as ΔV (y-axis) over P (x-axis), which yields a curve according to formula (1a).

Figure 4:
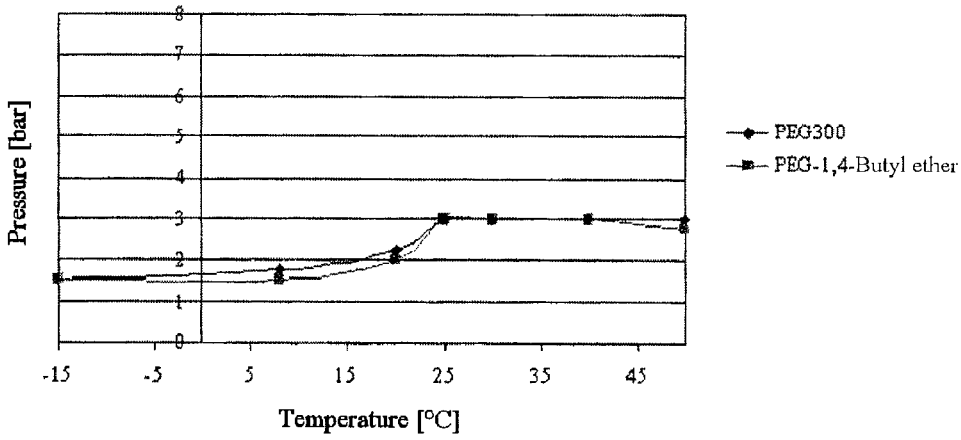
FIGS. 4, 5, 6 show for pressure vessels according to the invention how the pressure in the propellant chamber is dependent on the temperature, assuming three different starting pressures at 25° C.
Figure 5:
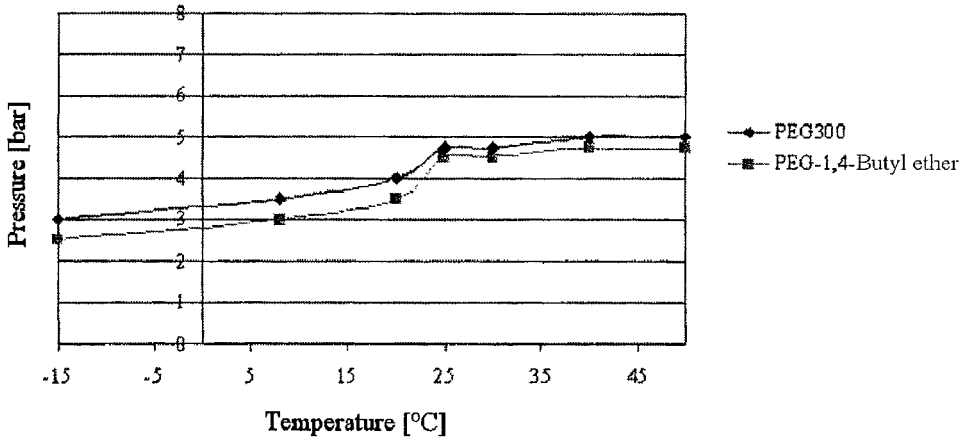
Figure 6:
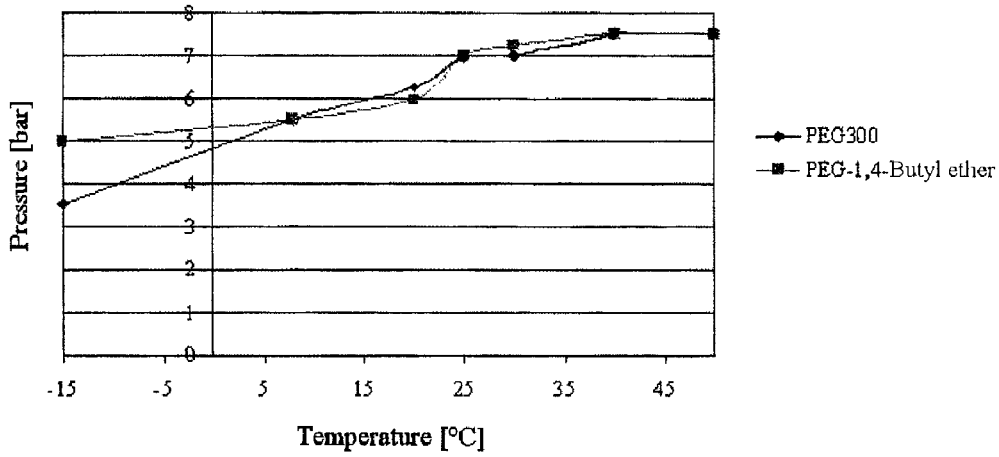

The temperature dependency of the pressure in the propellant chamber of the pressure vessel according to the invention is, surprisingly, relatively low. This is due to the fact that the pressure increasing along with the rising temperature in the gas phase is partially compensated by the carbon dioxide absorption, likewise increasing with the temperature, in the liquid phase, which leads to a reduction in the amount of carbon dioxide in the gas phase. FIGS. 4 to 6 show this by way of example for PEG 300 (FIGS. 4 and 5) and for PEG dibutyl ether (FIG. 6). At T~25° C., there is a change in pressure of ~2 bar. Below and above this jump in temperature, the pressure as a function of the temperature is relatively constant. The jump in the pressure at T~25° C. occurs independently of the amount of dissolved carbon dioxide and, accordingly, independently of the absolute value of the pressure at T~25° C.

The pressure vessels according to the invention have a separating part that is able to divide the interior space of the pressure vessel into a propellant chamber and a storage chamber in a variable manner. This separating part can take the form of any of the means that are used in previously known pressure vessels with a divided interior, for example in pressure vessels of the "bag-in-a-can" or "can-in-a-can" type mentioned in the introduction or of the type with a movable piston. The materials for the separating part are not critical, as long as they do not dissolve in the respective polyethylene glycol and/or monoether or diether of the polyethylene glycol. Examples of materials suitable for membrane-like separating parts are flexible plastics, rendered insoluble by crosslinking, such as vulcanized rubbers or latex, or crosslinked polyesters or polyether polyesters. Laminate films or pure metal films are also suitable, for example made of aluminium. Because of the use of the liquid phase in the propellant, the separating part should be able to permit liquid-tight division between storage chamber and propellant chamber. The separating part preferably also forms a gas-tight barrier between storage chamber and propellant chamber. In the pressure vessels according to the invention, the separating part is preferably designed as a movable piston or as an extensible and/or collapsible inner bag.

The pressure vessel according to the invention can also have a valve and a spray head, such that the substance can be dispensed in a controlled manner into the environment by actuation of the spray head and of the valve. The pressure vessel according to the invention is then preferably an aerosol container or a spray can. Alternatively, it can also be a cartridge, which does not have an outlet valve and in which a hole is pierced in the container wall only when fitted into a discharge device, the hole at the same time being closed by a discharge valve.

The expression "at least a part of the length of the central axis", as used in the claims, means preferably at least 50 percent of the length, relative to the total length of the central axis of the interior. In the case of an interior that is not rotationally symmetrical, the "central axis" is understood as the longest possible straight line that can be laid within the interior space and that is defined by the two geometric points of penetration of this line through the inner face of the wall of the interior space. In the case of rotationally symmetrical interior spaces the central axis is the axis of rotation. The total length of the central axis is in all cases defined by the two geometric points of penetration of the central axis through the inner face of the wall of the interior. The expression "at least a part of the interior", as used in the claims, means preferably at least 70 percent by volume, relative to the total volume of the interior.

In all embodiments of the pressure vessel according to the invention, the interior space preferably has along at least a part of the length of the central axis of the interior a rotationally symmetrical shape, in particular a cylindrical shape.

The substance that can be introduced into the pressure vessels according to the invention is a substance that is gaseous or liquid at the temperature at which the pressure vessel according to the invention is used, or a finely particulate dry substance, or a finely particulate substance suspended in a liquid, as is also used in the previously known pressure vessels, particularly in previously known aerosol containers. In the context of the present application, "finely particulate" is understood as meaning that the finely particulate substance can be sprayed using a conventional spray nozzle. Preferably, "finely particulate" is understood as a particle size from approximately 0.1 μm to approximately 100 μm particle diameter (measured as "mass median aerodynamic diameter", MMAD). In a particularly preferred embodiment, "finely particulate" is also understood as a particle size in an inhalable range from approximately 1 to approximately 6 μm.

The pressure vessels according to the invention can be produced and filled analogously to previously known pressure vessels. In particular, the embodiments for valves and spray heads, which are used for the pressure vessels according to the invention, can be analogous to the previously known pressure vessels, for example of the "bag-in-a-can" type mentioned in the introduction.

In general, work starts from a preshaped container blank made of a suitable material. The blank can be produced from a pressure-resistant thermoplastic material, for example from acrylonitrile/butadiene/styrene copolymer, polycarbonate or a polyester, such as polyethylene terephthalate, or preferably from a sheet metal, such as stainless steel sheet or aluminium sheet. The blank preferably has the shape of a cylinder, which can be tapered and rounded in the direction of its upper end surface. This blank can be produced in a manner known per se by injection moulding (for plastic containers) or by cold or hot extrusion (for metal containers).

Some examples of filling methods are described below:

1) A pressure vessel in which the division between storage chamber and propellant chamber is effected by a piston, a membrane or a bag can be filled by a method in which a container blank is used which is still open at its upper end and has a preferably inwardly bulged bottom surface with a closable opening (this method is analogous to the method described in EP-A-0 017 147). The piston is inserted through the still open upper end of the blank to a desired depth in the container blank, which depth will largely determine the volume ratio between storage chamber (above the piston) and propellant chamber (below the piston). In this embodiment, the container blank is tapered and rounded, if so desired, only after insertion of the piston. The substance is then introduced from above, such that it comes to lie on the piston, and the upper opening is closed by a plate which, if appropriate, can have an outlet valve, with the plate being crimped around the edge of the opening. As the final step, the propellant is introduced through the opening in the bottom of the blank until the desired pressure is reached, and the opening is closed with a suitable stopper.

2) A pressure vessel divided by an inner bag or a membrane can be filled in the following way: The inner bag or the membrane is inserted through the upper opening of a container blank in the manner described under 1) (although the blank in this case can already be tapered at the top) and is secured tightly round the edge of the opening. The substance is then introduced from above through the upper opening. The inner bag in the blank is unfolded under the filling action or the membrane is extended and, in this way, a storage chamber filled with the substance is formed in the upper part of the blank. The opening, with the part of the bag or of the membrane bearing tightly on its edge, is then closed in a gastight manner by means of a plate, which can optionally have a valve, being crimped around it. Finally, the propellant is again introduced through the opening in the bottom of the blank until the desired pressure is reached, and the opening is closed with a suitable stopper.

3) A pressure vessel with an inner bag as the separating part and with a valve can also be produced starting from a container blank that has a bottom without an opening. As a first step, a predetermined amount of propellant is introduced into the blank from above. A plate, which has a valve and on which the inner bag or the membrane is already secured in a gastight manner, is then flanged or crimped onto the edge of the blank previously filled with propellant. The inner bag or the membrane is in this case still free of the sprayable substance. The plate here preferably has a hollow dip tube which is connected to the valve and which is provided with holes and onto which the inner bag or the membrane is initially laid or wound. This dip tube comes into the interior of the container blank during the flanging or crimping of the cover. After the plate has been flanged or crimped on, the substance is introduced into the inner bag or membrane through the valve stem at a pressure greater than the inner pressure of the propellant prevailing in the container blank. When said dip tube is used, the substance flows through the valve stem into the dip tube and inflates the inner bag by way of the holes present in the dip tube.

4) A pressure vessel with an inner bag or of the "can-in-a-can" type, with a valve, can be filled in the following way: The inner bag or the inner can, which can still be empty or can already be filled, is first inserted into the interior of the container blank. A valve is placed with its valve plate onto the edge of the container blank, but only loosely and in any case not in a liquid-tight manner, or is held at a very slight distance above the edge of the container blank. A filler device in accordance with the principle of a bell is pushed on from above over the container blank and the loosely fitting valve plate, said filler device bearing from outside in a liquid-tight manner on the outer wall of the container blank, which can be achieved using a suitable seal. Since the valve plate does not rest tightly on the edge of the container blank, the pressurized propellant can then be introduced with the aid of the filler device into the interior of the container blank through the non-liquid-tight gap between the valve plate and the edge of the container blank. After the interior has been filled with the propellant, the valve plate has to be connected in a gas-tight manner to the edge of the container blank, which is typically done with the aid of a seal arranged in the valve plate and again by crimping the edge of the valve plate. Thereafter, if the inner bag or the inner can was not already filled with the sprayable substance, it can be filled with the substance by way of the valve stem.

5) In the case of a container with a piston as the separating part, it is also possible to use a cylindrical container blank which is closed at the top, and optionally already has a valve, but whose bottom is still open. In this case, a predetermined amount of the substance is first introduced into the container blank turned upside down, after which the piston is pushed down to a desired depth into the blank. A suitable amount of the propellant is then introduced, and a container bottom is flanged onto the lower end of the pressurized container blank.

Some of the propellants that can be used in the pressure vessels according to the invention are themselves novel and are therefore also part of the subject matter of the present invention. These are propellants composed of: a) a gas phase comprising carbon dioxide, and b) a liquid phase comprising more than 90 percent by weight, relative to the liquid phase, of a polyethylene glycol, and carbon dioxide dissolved therein, with the proviso that the compound is not polyethylene glycol 400.

The comments made above concerning preferred molecular weight ranges and the polyethylene glycol contents in the liquid phase are also applicable to the propellants according to the invention.

Specific embodiments of the pressure vessel according to the invention are now described with reference to the figures.

FIG. 1 shows a cylindrical aerosol container which has an outer wall 1 of aluminium sheet and which, in its interior, has an inner bag 2 that divides the interior space into a storage chamber 3 and a propellant chamber 4. The propellant chamber 4 contains a propellant according to the invention. This propellant consists of a gas phase 5, with a total pressure in the gas phase of typically approximately 5 bar, wherein the ratio of the partial pressure of carbon dioxide to the total pressure can be approximately 0.98, and of a liquid phase 6 consisting essentially of polyethylene glycol with $M_W$ 300 and carbon dioxide dissolved therein. The storage chamber 3 is filled with a liquid substance 7, which can be sprayed from the aerosol container by means of a conventional valve (not shown in the figure) and by means of a conventional spray head 8. The filled aerosol container is shown on the left and the largely emptied aerosol container is shown on the right, the membrane 2 having been drawn upwards.

Figure 2:
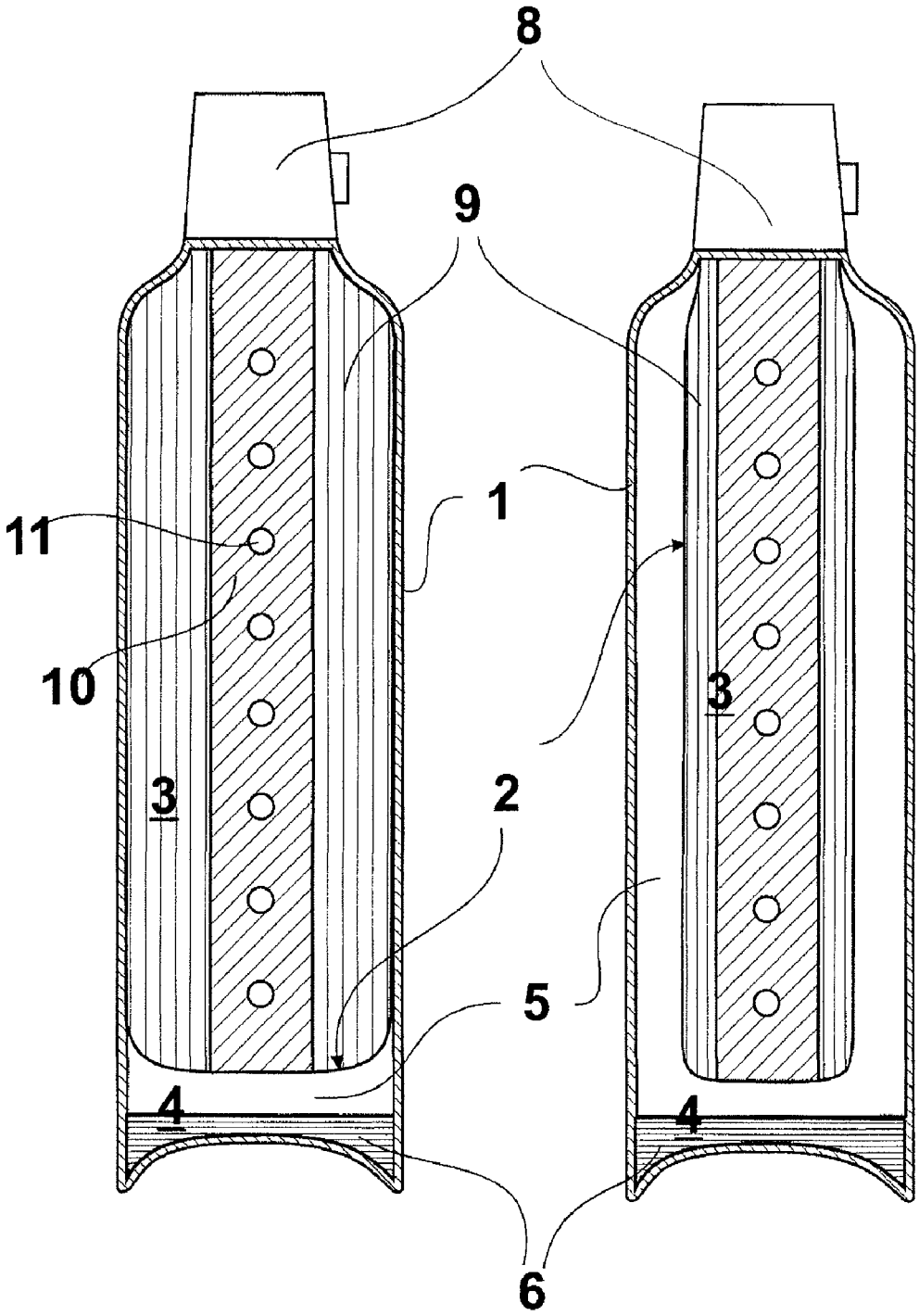

FIG. 2 shows an aerosol container according to the invention with an outer wall 1 made of stainless steel sheet. Its interior space is divided by means of an inner bag 2 into a storage chamber 3 and a propellant chamber 4. The storage chamber 3 is filled with a finely particulate substance 9 (for example a dry powder with an inhalable particle size). The propellant chamber 4 contains a propellant consisting of a gas phase 5 and of a liquid phase 6. The gas phase has a total pressure of typically approximately 4 bar, wherein the ratio of the partial pressure of carbon dioxide to the total pressure can be approximately 0.99. The liquid phase 6 consists essentially of PEG with $M_W$ 250 and carbon dioxide dissolved therein. In this embodiment, the inner bag 2 has, on its inside, a hollow dip tube 10 with through-openings 11. Upon compression and/or collapse of the inner bag 2 (right-hand side of FIG. 2), the sprayable substance 9 is forced through the openings 11 into the dip tube 10; the dip tube 10 leads to the valve (not shown) arranged in the interior of the spray head 8.

Figure 3:
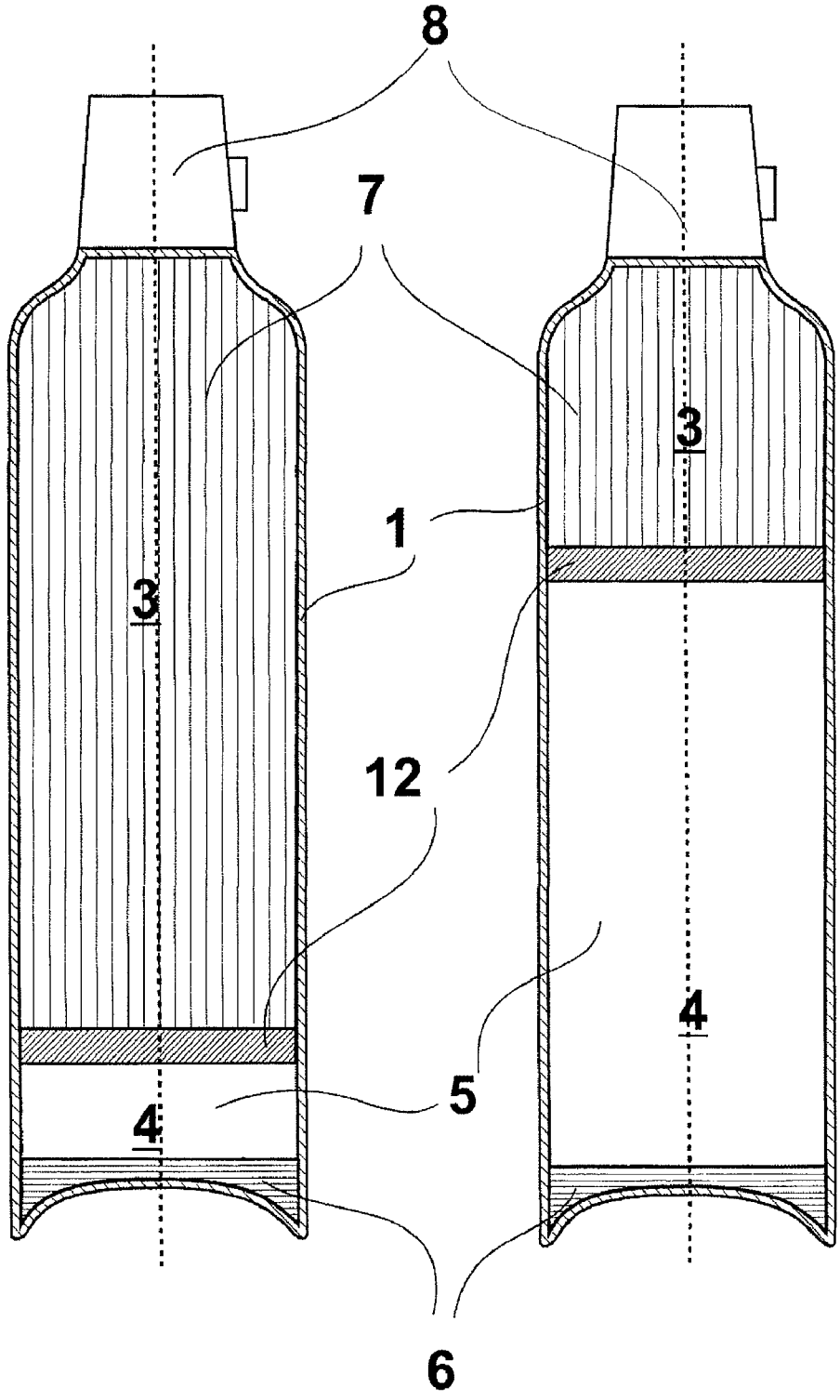
FIG. 3 shows a pressure vessel according to the invention with a movable piston, in two different states of filling.

FIG. 3 shows an aerosol container according to the invention with an outer wall 1 made of stainless steel sheet. The interior space of the aerosol container is divided into a storage chamber 3 and a propellant chamber 4 by means of a piston 12, which can be made of PVC, for example. This embodiment of the aerosol container has, along at least a part of the length of the central axis, a cross section of constant shape, preferably a cylindrical cross section. In the figure, the central axis is shown as a dotted line. The piston 12 exactly fits the cross section of the interior space. The storage chamber contains a liquid substance 7 to be sprayed. The propellant chamber 4 contains a propellant composed of a gas phase 5 and of a liquid phase 6. The gas phase has a total pressure of typically approximately 4 bar, wherein the ratio of the partial pressure of carbon dioxide to the total pressure can be approximately 0.95. The liquid phase 6 consists essentially of the dibutyl ether of a polyethylene glycol, which has a $M_W$ of approximately 350, and carbon dioxide dissolved therein. A spray head 8 is mounted on the head of the aerosol container and, in its inside, has an outlet valve (not shown in the figure). The right-hand side of FIG. 3 shows how the volume of the storage chamber 3 has decreased by means of the upward sliding of the piston 12.

FIGS. 4 to 6 show the dependence of the pressure in the propellant chamber on the temperature, if the liquid phase contains PEG with $M_W$ 300 or PEG dibutyl ether. For these measurements, plasticized glass vials with a volume of 100 ml were used as simulated propellant chambers. They were first clinched and evacuated, and the liquid phase of the propellant (approximately 10 g), still free of carbon dioxide, was injected into the evacuated glass vials using a syringe. The desired amount of $CO_2$ was then fed from the gas canister into the glass vials with shaking until, after equilibration at 25° C., the desired starting pressure was reached. Three different starting pressures were chosen (FIG. 4: 2.5 bar; FIG. 5: ca. 5 bar; FIG. 6: 7 bar). The pressure was measured at different temperatures. A temperature of −15° C. was reached in a salt solution that was cooled beforehand in a deep-freezer. A temperature of 8° C. was reached through equilibration in a refrigerator. Equilibration of the glass vials to the temperatures of 20° C., 25° C., 30° C., 40° C. and 50° C. was done in a water bath. The pressure reached after equilibration was measured using a manual pressure gauge.

The same experimental protocol as that used in FIGS. 4 to 6 also makes it possible to determine, at a given constant temperature, the dependence of the pressure in the gas phase on the total amount of added carbon dioxide. For example, the following findings were obtained for PEG 300 at 25° C.:

| | | | |
|---|---|---|---|
| P (T = 25° C.) [bar] | 3 | 4.75 | 7 |
| wt % ($CO_2$) | 1.6 | 2.8 | 4.0 |
| $x_{CO2}$ | 0.0998 | 0.1641 | 0.2212 |

With the $P/x_{CO2}$ values from the above table, the H and $H_0$ for the abovementioned formula (2) can be determined by means of linear regression for PEG 300.

Figure 7:
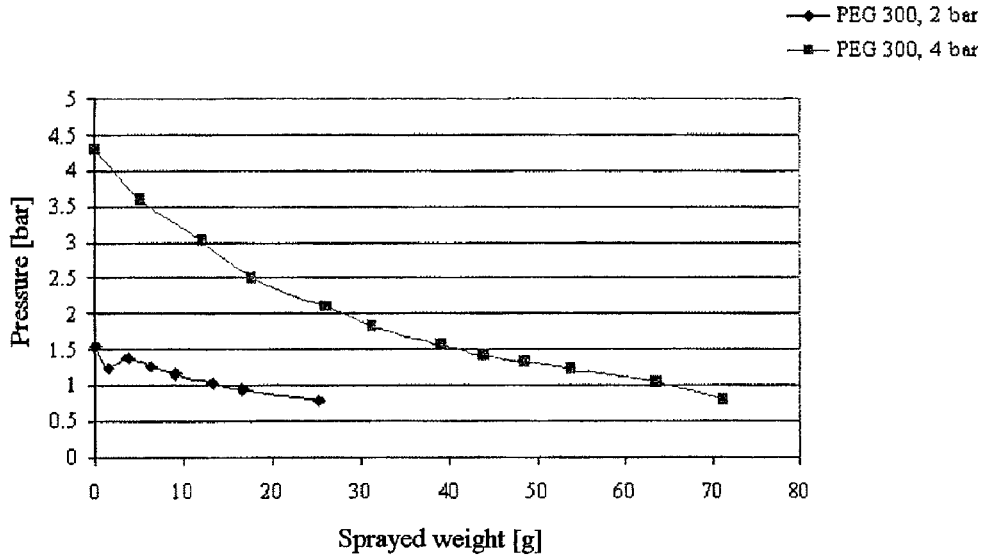
FIGS. 7, 8 show for pressure vessels according to the invention how the pressure in the propellant chamber is dependent on the sprayed volume of the sprayable substance.
Figure 8:
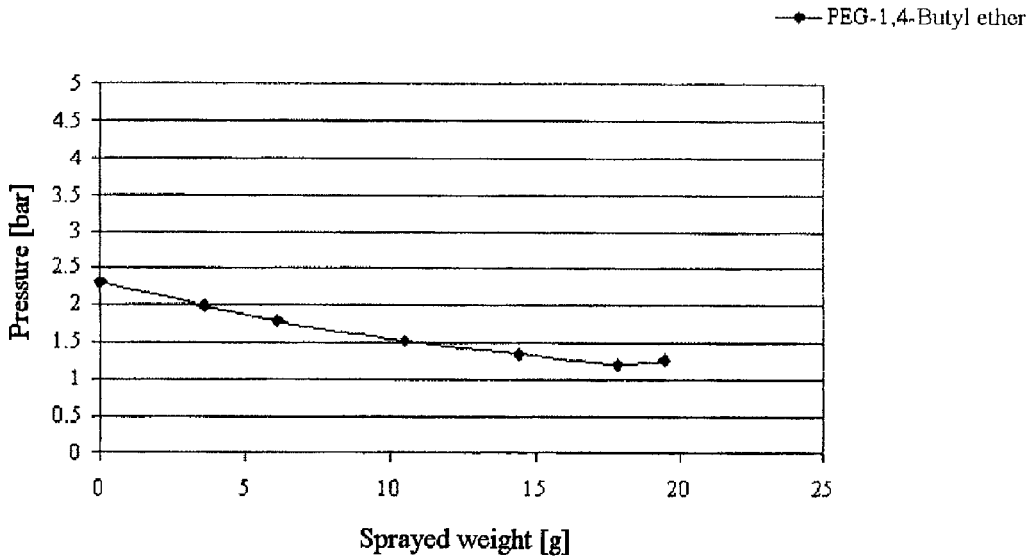

FIGS. 7 and 8 show the measured dependence of the pressure P in the propellant chamber of aerosol containers (spray cans) according to the invention as a function of sprayed volume ΔV. The respective liquid phase, still free of carbon dioxide, was placed in a mixing cylinder, which withstands a maximum pressure of 10 bar, and closed. $CO_2$ was added to the liquid phase via a valve with integrated tap. To saturate the liquid phase with $CO_2$ completely, $CO_2$ was let in until a pressure of 10 bar was reached in the mixing cylinder. The valve was closed, and the measuring cylinder was vigorously shaken until the pressure remained constant even with shaking. $CO_2$ was then let in again. This procedure was repeated until the desired pressure in the mixing cylinder was maintained even after shaking. Using a pump, the propellant thus prepared in advance, which contained approximately 5 percent by weight of carbon dioxide, was then pumped without gas phase into the filling machine ("Pamasol" product filler) and introduced into commercially available cans with inner bag. The nominal volume of the cans was in each case 118 ml, the volume of their inner bag was 60 ml, and the amount of propellant introduced was 12 g per can. To simulate a substance to be sprayed from a can, water was introduced into the inner bag using the product filler. The eventual starting pressure in the cans is shown in FIGS. 7 and 8 on the y-axis. The water was then sprayed from the can, and the pressure as a function of the weight loss of the spray can was measured (1 g weight loss=1 ml sprayed volume) and plotted on a graph.

The invention claimed is:

1. A pressure vessel for receiving a pressurized substance in gaseous, liquid or finely particulate form, said pressure vessel comprising:

a wall with an inner wall face that defines an interior space of the pressure vessel; and a separating part located in the interior space and dividing the interior space into a storage chamber and into a propellant chamber, wherein the storage chamber contains the substance and the propellant chamber contains a propellant, wherein the separating part is configured to permit liquid-tight division into the storage chamber and the propellant chamber and, under the action of the propellant, is configured to vary the ratio of the volume of the storage chamber to the volume of the propellant chamber in favour of the volume of the propellant chamber, and wherein the propellant comprises:

a) a gas phase comprising carbon dioxide, and b) a liquid phase comprising (i) a compound, chosen from the group consisting of polyethylene glycols, their ($C_1$-$C_4$) monoethers, and their ($C_1$-$C_4$) diethers, and (ii) carbon dioxide dissolved therein.

2. The pressure vessel according to claim 1, wherein the separating part is an extensible and/or collapsible inner bag which, by contraction and/or collapse, is able to vary the ratio of the volume of the storage chamber to the volume of the propellant chamber.

3. The pressure vessel according to claim 1, wherein the interior space has a central axis and, extending along at least a part of the length of the central axis, which part is continuous, has a cross section that is constant in terms of its shape and surface area and that is perpendicular to the central axis, and wherein the separating part is a movable piston which bears with an exact fit on the inner wall face and, by means of movement along said part of the central axis, is configured to vary the ratio of the volume of the storage chamber to the volume of the propellant chamber.

4. The pressure vessel according to claim 1, wherein at least a part of the interior space has a cylindrical shape.

5. The pressure vessel according to claim 1, wherein the total proportion of polyethylene glycol and polyethylene glycol monoether and polyethylene glycol diether and dissolved carbon dioxide in the liquid phase amounts to more than 90 percent by weight, relative to the liquid phase.

6. The pressure vessel according to claim 1, wherein the polyethylene glycol or the polyethylene glycol monoether or the polyethylene glycol diether has a $M_w$ in the range of 200 to 600.

7. The pressure vessel according to claim 1, wherein the liquid phase comprises a polyethylene glycol or a polyethylene glycol 1,4-dibutyl ether.

8. The pressure vessel according to claim 1, wherein in the gas phase of the propellant, the ratio of the partial pressure of carbon dioxide to the total pressure is at least 0.90.

9. The pressure vessel according to claim 1, wherein it is able to dispense the substance from the storage chamber in a controlled manner by means of a valve.

10. The pressure vessel according to claim 9, wherein it is able to spray the substance by means of a spray head.

11. The pressure vessel according to claim 10, wherein it is an aerosol container.

12. The pressure vessel according to claim 1, wherein it is a cartridge.

13. A method for controlled dispensing of a substance in gaseous, liquid or finely particulate form, wherein the substance is made available in the storage chamber of a pressure vessel according to claim 1, and the substance is dispensed from the storage chamber of the pressure vessel in a controlled manner by means of a valve.

14. The method according to claim 13, wherein the substance is sprayed by means of a spray head.

* * * * *